US010508880B1

(12) United States Patent
Bonderer et al.

(10) Patent No.: US 10,508,880 B1
(45) Date of Patent: Dec. 17, 2019

(54) FIREARM ROTATION LIMITER AND METHOD

(71) Applicants: D. Austin Bonderer, Fullerton, CA (US); Bradley Sheridan, Alta Loma, CA (US)

(72) Inventors: D. Austin Bonderer, Fullerton, CA (US); Bradley Sheridan, Alta Loma, CA (US)

( * ) Notice: Subject to any disclaimer, the term of this patent is extended or adjusted under 35 U.S.C. 154(b) by 0 days.

(21) Appl. No.: 16/208,735

(22) Filed: Dec. 4, 2018

Related U.S. Application Data

(63) Continuation of application No. 15/983,349, filed on May 18, 2018, now Pat. No. 10,145,638.

(60) Provisional application No. 62/508,000, filed on May 18, 2017.

(51) Int. Cl.
*F41A 23/18* (2006.01)
*F41G 11/00* (2006.01)

(52) U.S. Cl.
CPC ..... *F41A 23/18* (2013.01); *F41G 11/003* (2013.01)

(58) Field of Classification Search
CPC ..... F41A 23/18; F41G 11/003
USPC ..... 42/90
See application file for complete search history.

(56) References Cited

U.S. PATENT DOCUMENTS 3,834,052 A * 9/1974 Steck, III ..... F41G 11/001 42/124
4,837,963 A * 6/1989 Slappey, Jr. ..... B25B 27/02 42/90
5,555,662 A * 9/1996 Teetzel ..... F41A 9/62 356/10
5,930,935 A * 8/1999 Griffin ..... F41C 27/06 42/105
6,872,039 B2 * 3/2005 Baus ..... F16B 21/125 411/347
7,021,187 B1 * 4/2006 Grassi ..... F42B 30/04 89/6.5
7,409,912 B2 * 8/2008 Cerovic ..... F41H 13/0018 102/502
7,937,876 B1 * 5/2011 Graham ..... F41A 11/00 42/75.01
9,151,555 B1 * 10/2015 Huang ..... F16B 15/02
9,389,031 B2 * 7/2016 Gardner ..... F41A 3/66
2005/0132628 A1 * 6/2005 Olson ..... F41A 17/74 42/105
2006/0191183 A1 * 8/2006 Griffin ..... F41C 23/16 42/72
2007/0271832 A1 * 11/2007 Griffin ..... F41C 23/16 42/72
2009/0277069 A1 * 11/2009 Delmonico ..... F41C 27/00 42/105
2015/0052793 A1 * 2/2015 Cassady ..... F41A 9/61 42/8
2015/0059221 A1 * 3/2015 Bero ..... F41A 3/66 42/16

* cited by examiner

*Primary Examiner* — Joshua E Freeman
(74) *Attorney, Agent, or Firm* — The Law Office of Austin Bonderer, PC; Austin Bonderer

(57) ABSTRACT

A method an apparatus for limiting the rotation of an upper assembly in relation to a subassembly of a firearm is disclosed. The apparatus has a rotation block having a housing; a sliding abutment coupled to the housing and coupled to an actuator; and an attachment coupled to the housing and configured to attach to an upper assembly of a firearm. The sliding abutment is able to move relative to the housing.

6 Claims, 5 Drawing Sheets

FIREARM ROTATION LIMITER AND METHOD

FIELD

The subject matter herein generally relates to long guns and their ability to rotate about a sub-assembly.

BRIEF DESCRIPTION OF THE DRAWINGS

Implementations of the present technology will now be described, by way of example only, with reference to the attached figures, wherein.

DETAILED DESCRIPTION

Figure 1:
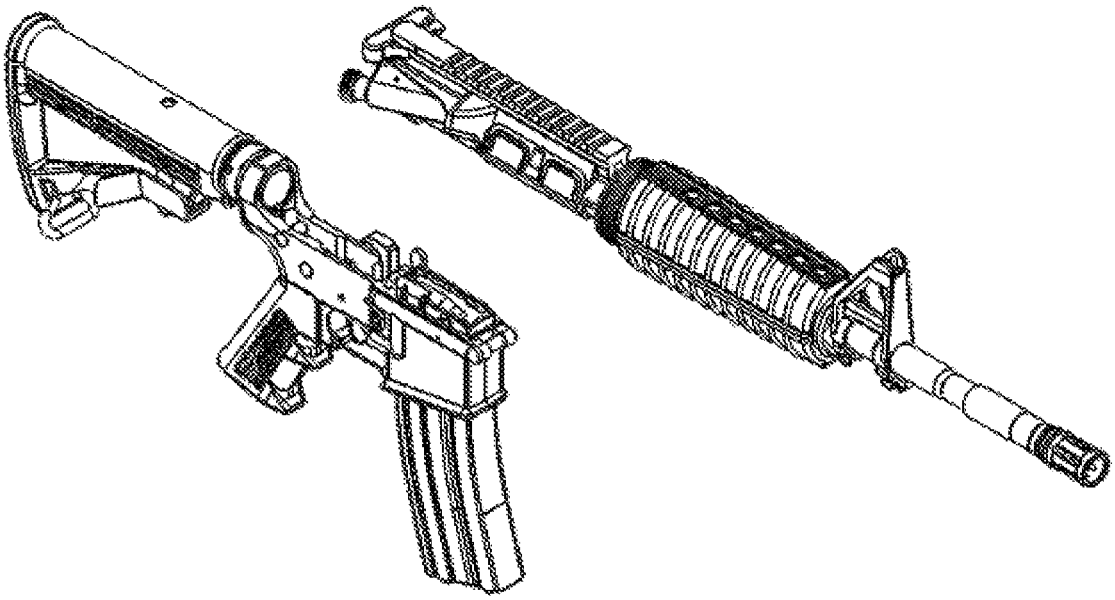
(PRIOR ART) FIGURE 1
FIG. 1 shows the 2 halves of a rifle that can be attached according to the prior art.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale, and the proportions of certain parts may be exaggerated to illustrate details and features better. The description is not to be considered as limiting the scope of the embodiments described herein. It should be noted that references to "an" or "one" embodiment in this disclosure are not necessarily to the same embodiment, and such references mean at least one.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising" means "including, but not necessarily limited to"; it specifically indicates open-ended inclusion or membership in a so-described combination, group, series and the like. The term 'metal' is defined to include metals and alloys.

The present disclosure is described in relation to the figures. The rotation block 1 can be coupled to the upper of a rifle. While the disclosure is discussed in reference to an AR platform rifle, other rifles can be used.

Figure 2:
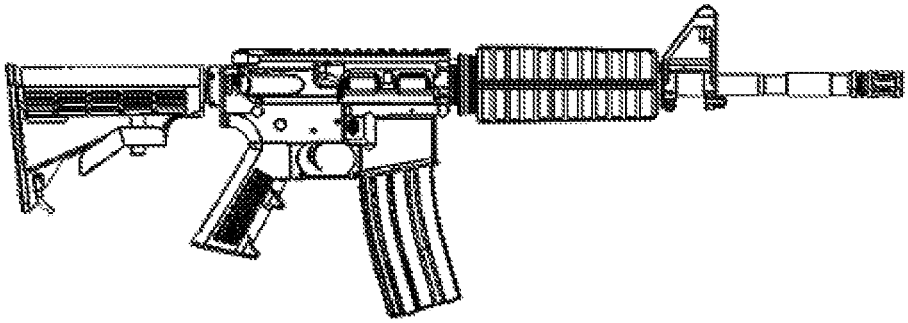
(PRIOR ART) FIGURE 2
FIG. 2 is the rifle configured in its normal operating condition according to the prior art.
Figure 3:
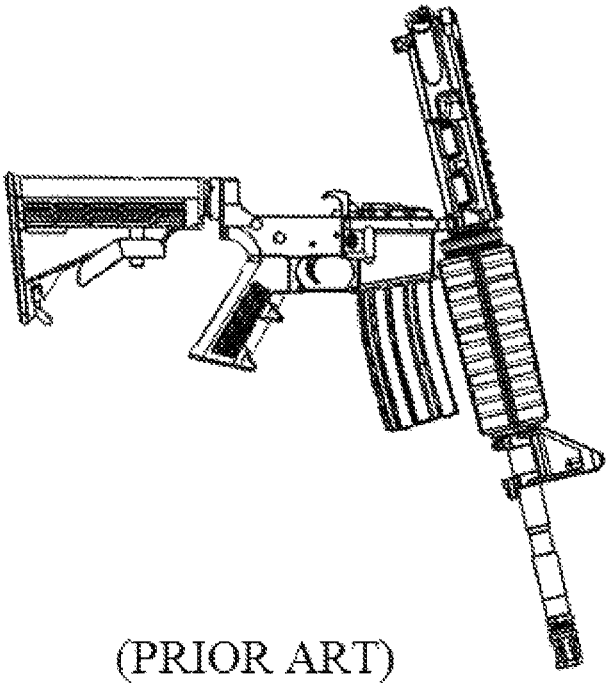
(PRIOR ART) FIGURE 3
FIG. 3 is the barreled portion of the rifle rotated forward.

FIG. 1 shows an upper removed from the sub-assembly according to the prior art. FIG. 2 shows a fully assembled rifle. FIG. 3 shows a partially attached and rotated upper. This is done to allow access to the inside of the firearm for cleaning or repair purposes. The 2 halves of the rifle rotate freely from a closed to this position. Often the maintenance or repair may be easier to do with the rifle in this condition.

Figure 4:
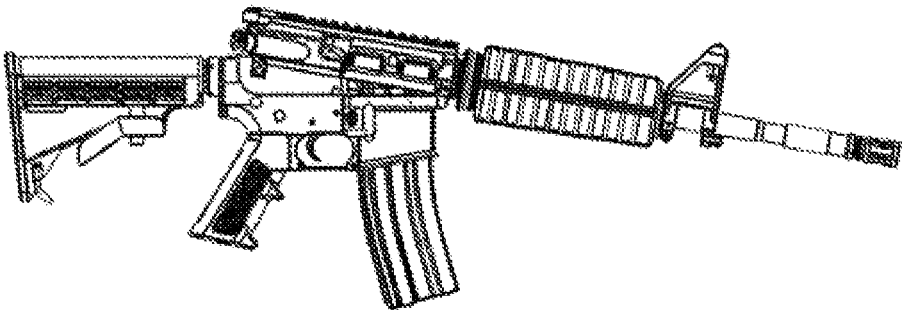
(PRIOR ART) FIGURE 4
FIG. 4 shows the rifle, just slightly opened for repair and or maintenance work according to the prior art.

As seen in FIG. 4, often times a slight rotation of the upper assembly is desired while holding the rifle. This is very awkward as the upper assembly has some weight and will rotate wildly about the rotation point. According to the prior art, there is nothing stopping the rotation of the upper from the sub-assembly.

Figure 5:
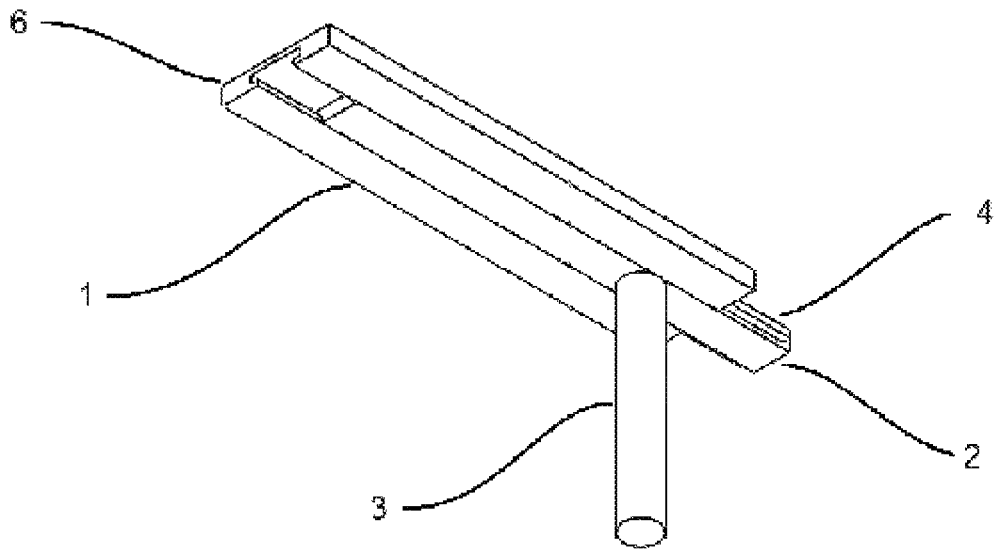
FIG. 5 shows one embodiment of the rotation block.
Figure 6:
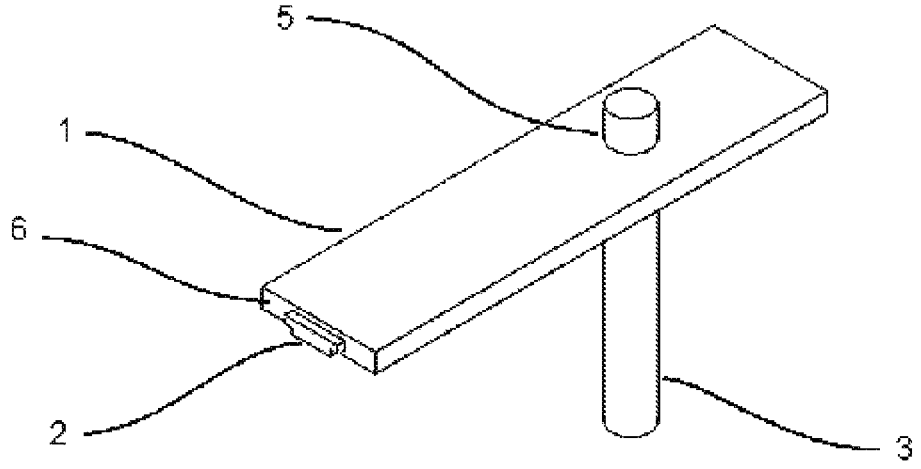
FIG. 6 shows an embodiment of a rotation block from above.

As can be seen in FIGS. 5 and 6, in some embodiments, the rotation block comprises a sliding abutment 2 that is attached to an actuator 3 and slides within the housing 6. The sliding abutment 2 will allow the rotation block 1 to remain in place during an increased rotation of the upper. In some embodiments, the sliding abutment 2 will have selective lengths. One length can allow for partial rotation. A second length will prevent any substantial rotation of the upper. A third length can allow for full rotation. There can be other positions as well to allow for varying degrees of rotation. The sliding abutment 2 can have enlarged bumper that will abut the lower.

Figure 7:
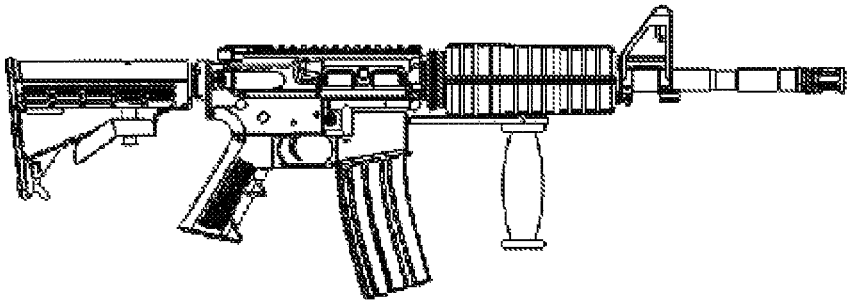
FIG. 7 shows an embodiment of the rotation block on a rifle in a normal firing position.
Figure 8:
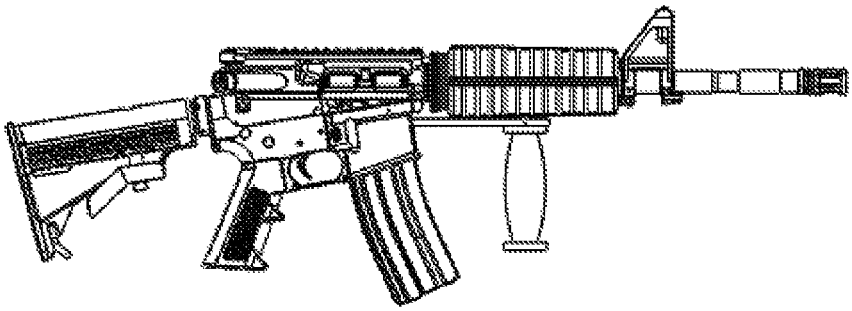
FIG. 8 shows an embodiment of the rotation block on a rifle, with the rifle partially opened the embodiment rotation blocking further rotation.

As can be seen in FIGS. 7 and 8, in some embodiments, the rotation block has a fixed length but is placed on the upper such that when the upper is rotated about the pin a certain degree, the rotation block will abut the lower and limit the amount of rotation.

In some embodiments, the rotation block will have an ergonomic shape that will is adapted to have a resting spot for the hand to hold the upper.

In some embodiments, the rotation block has a handle that will extend from the rotation block 1. In some embodiments, the handle will extend substantially perpendicular to the upper.

In some embodiments, an attachment 5 attaches to the upper assembly. The means of attachment include a strap, a threaded member, a rail attachment (i.e., Picatinny and Weaver), adhesive, and adhesive strips.

In some embodiments, the rear pin has a handle. In some embodiments, the handle is a loop. In some embodiments, the rear pin is connected to the lower by an attachment. In some embodiments, the attachment can comprise a flexible element (e.g., cord) that is wrapped around the lower or the stock.

Figure 9:
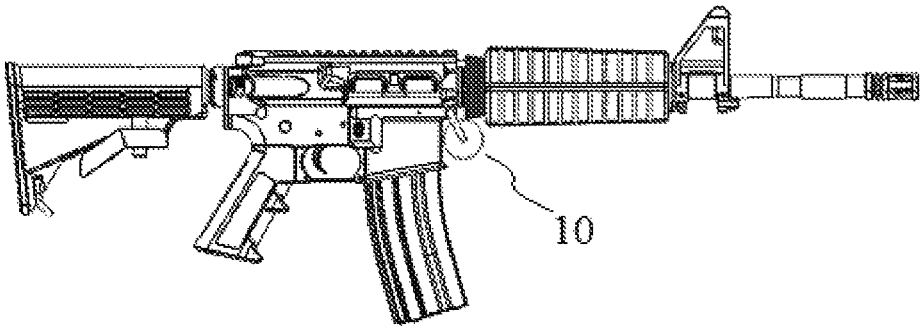
FIG. 9 shows an embodiment of a bumper pin in use with a firearm.
Figure 10:
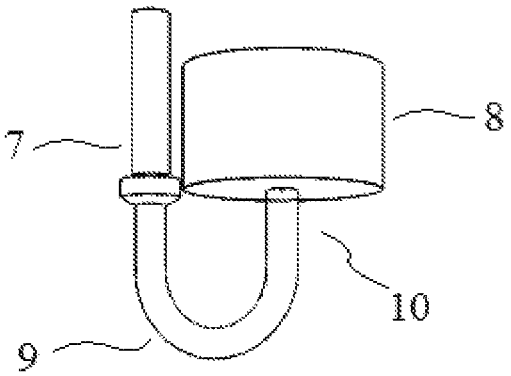
FIG. 10 shows a top view of an embodiment of the bumper pin.
Figure 11:
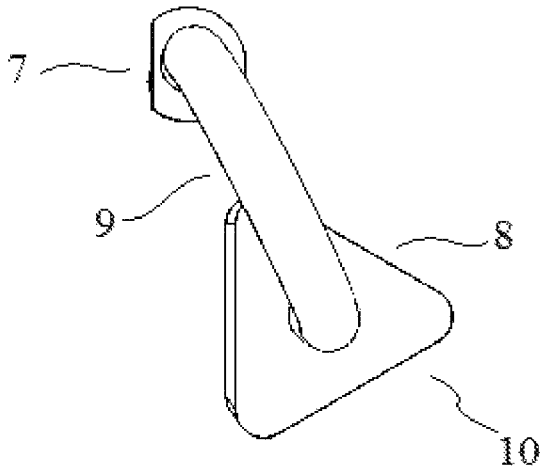
FIG. 11 shows a front view of an embodiment of the bumper pin.

In FIGS. 9-11, embodiments of a bumper pin 10 is shown. The bumper pin 10 comprises a pin 7 designed to replace the pin of a firearm, a bumper 8, and a connector 9 between the two. The pin 7 can be sized and shaped substantially the same as the OEM for which it would replace. The bumper 8 is sized and shaped to prevent the upper assembly from fully rotating in relation to the sub-assembly. In some embodiments, the pin is made or metal. The bumper can comprise a material, or coated with a material, that will not harm the finish and/or other components of the firearm. While the bumper has been shown with a round and a generally triangular shape, it is understood that any shape and size that would limit the rotation can be used. A connector 9 connects the pin 7 and the bumper 8. The connector can be any material.

In some embodiments, the bumper pin 10 comprises metal. The pin 7, connector 9 and the bumper 8 would be made of a single piece of metal, while the bumper is coated with a coating.

The bumper pin can limit the upper assembly rotation to 5 degrees, 10 degrees, 15 degrees, 20 degrees, 25 degrees, 30 degrees, 40 degrees, 45 degrees in respective embodiments.

It is also understood that the configuration of the upper assembly and subassembly can alter the distance of rotation. For example, a barrel cover (as seen in FIG. 9) and a Picatinny rail will change the distance between the upper assembly and the subassembly.

The embodiments shown and described above are only examples. Even though numerous characteristics and advantages of the present technology have been set forth in the foregoing description, together with details of the structure and function of the present disclosure, the disclosure is illustrative only, and changes may be made in the detail, including in matters of shape, size and arrangement of the parts within the principles of the present disclosure up to, and including, the full extent established by the broad general meaning of the terms used in the claims.

It should also be noted that elements of embodiments may be described with reference to the description of a particular embodiment; however, it is disclosed that elements of disclosed embodiments can be switched with corresponding elements of embodiments with the same name and/or number of other disclosed embodiments.

Depending on the embodiment, certain steps of methods described may be removed, others may be added, and the sequence of steps may be altered. It is also to be understood that the description and the claims drawn to a method may include some indication in reference to certain steps. However, the indication used is only to be viewed for identification purposes and not as a suggestion as to an order for the steps.

What is claimed is:

1. An apparatus comprising:

a rotation block comprising a housing; a sliding abutment coupled to the housing and coupled to an actuator; and an attachment coupled to the housing and configured to attach to an upper assembly of a firearm comprising an upper and a sub-assembly;

wherein the sliding abutment is configured to move relative to the housing between a first position and a second position; when the attachment is attached to the upper, in the first position, the sliding abutment is configured to allow rotation of the upper in relation to the sub-assembly a first rotation amount, and in the second position, the sliding abutment is configured to allow rotation of the upper in relation to the sub-assembly a second rotation amount and the first rotation amount is less than the second rotation amount.

2. The apparatus of claim 1, wherein the sliding abutment is configured to move relative to the housing to a third position; in the third, the sliding abutment is configured to allow rotation of the upper in relation to the sub-assembly a third rotation amount and the second rotation amount is less than the third rotation amount.

3. The apparatus of claim 1, wherein the second rotation amount equals full rotation of the upper in relation to the sub-assembly.

4. The apparatus of claim 2, wherein the third rotation amounts equals full rotation of the upper in relation to the sub-assembly.

5. An apparatus comprising:

a firearm comprising an upper and a sub-assembly; and a rotation block comprising a housing; a sliding abutment coupled to the housing and coupled to an actuator; and an attachment coupled to the housing;

wherein the attachment is coupled to the firearm; the sliding abutment is configured to move between a first position and a second position; in the first position, the sliding abutment prevents full rotation of the upper in relation to the sub-assembly by abutting the sub-assembly after a partial rotation of the upper in relation to the sub-assembly; and in the second position, the sliding abutment does not interfere with the rotation of the upper in relation to the sub-assembly.

6. An apparatus comprising:

a firearm comprising an upper assembly and a sub-assembly; and a rotation block comprising a housing; a sliding abutment coupled to the housing and coupled to an actuator; and an attachment coupled to the housing and coupled to the upper; wherein the sliding abutment is configured to move relative to the housing;

wherein the sliding abutment is configured to move between a first position and a second position; in the first position, the sliding abutment prevents full rotation of the upper assembly in relation to the sub-assembly by abutting the sub-assembly after a partial rotation of the upper assembly in relation to the sub-assembly; and in the second position, the sliding abutment does not interfere with the rotation of the upper assembly in relation to the sub-assembly.

* * * * *